United States Patent [19]

Kiang

[11] 3,956,984

[45] May 18, 1976

[54] STENCIL PRINTER

[76] Inventor: John Chien Kuen Kiang, 53100 Juniper Road, South Bend, Ind. 46637

[22] Filed: Jan. 23, 1975

[21] Appl. No.: 543,248

[52] U.S. Cl. ..... 101/124; 101/126; 101/356; 101/364; 101/407 BP

[51] Int. Cl.[2] ..... B41L 13/02; B41L 27/08

[58] Field of Search ..... 101/123, 124, 126, 127.1, 101/128.1, 350, 356, 363, 364, 407 R, 407 BP, 329, 330

[56] References Cited

UNITED STATES PATENTS

| | | | |
|---|---|---|---|
| 1,933,887 | 11/1933 | Wood | 101/364 X |
| 2,176,771 | 10/1939 | Nachman | 101/126 |
| 2,332,159 | 10/1943 | McAfee | 101/126 |
| 2,382,103 | 8/1945 | Sandman | 101/365 |
| 2,813,538 | 11/1957 | Genova | 101/364 X |
| 3,052,183 | 9/1962 | Zernov et al. | 101/364 X |
| 3,094,924 | 6/1963 | Stark | 101/364 X |
| 3,099,207 | 7/1963 | Kiang | 101/124 |
| 3,318,239 | 5/1967 | Wintizer | 101/364 |

*Primary Examiner*—Edgar S. Burr
*Assistant Examiner*—R. E. Suter
*Attorney, Agent, or Firm*—Oltsch & Knoblock

[57] ABSTRACT

A stencil printer has a base mounting an ink container and yieldable guides adapted to be traversed by a stencil carrier and a card carrier. The ink container has curved bottom and end walls and is spanned by a removable flexible plastic sheet confined by removable bearing blocks which journal the ends of roller shafts. The stencil holder releasably anchors a stencil in a manner convenient for removal and in proper printing position. The card carrier includes a card anchor spring urged to anchoring position and releasable incident to movement of the carrier to a releasing position. The device includes cushioning bumpers to deaden noise incident to operating movement of the device.

5 Claims, 9 Drawing Figures

STENCIL PRINTER

This invention relates to improvements in stencil printers, and more particularly stencil printers of the type disclosed in my U.S. Pat. No. 3,099,207, dated July 30, 1963.

Stencil printers employ a stencil and are used as a means for printing card stock, such as library cards, postal cards, record cards and the like. The card to be printed must be positioned accurately upon a holder for desired registration or relation to the stencil in a stencil holder. The card is replaced after each printing operation.

It is a primary object of this invention to provide a device with a novel card holder which can be operated quickly and easily to remove and then re-apply a card in desired orientation or position.

Stencil printers require a reservoir or container for ink in which an inking roller is partially immersed and against which roller the stencil is pressed during the printing operation for ink transfer through the stencil to the card to be printed. The printing ink must be replaced from time to time as incident to drying of the ink or to requirement for replacement of the ink, as to change the color of the ink being used. The ink container or reservoir must be cleaned from time to time to accommodate changes in the ink supply and this has been a time-consuming operation with prior devices. It is therefore another object of this invention to provide an ink container with a novel mount for releasably supporting inking rollers therein.

Still another object of the invention is to provide an inking container with a novel liner removable to facilitate cleaning of the ink container.

Stencil printers require a stencil holder which can be moved relative to a base and an ink roller during a printing operation and which is normally positioned in an inoperative or spaced relation to the ink applying means when not in use. Stencil holders must accurately position the stencil and accommodate quick and easy replacement of the stencil. It is therefore a further object of the invention to provide a stencil printer with a novel stencil holder to which a stencil may be applied quickly in accurate relation for printing, from which it may be quickly removed for replacement, and which is readily moved to printing position.

Stencil printers require relatively movable parts which are formed of metal and which must move relative to each other between limit positions during use. Such movement is commonly accompanied by noise and clatter which is disturbing to others working in an environment, such as a library, where quiet conditions are desired. It is a further object of this invention to provide a stencil printer which minimizes noise of operation thereof.

Other objects will be apparent from the following specification.

IN THE DRAWINGS

Figure 1:
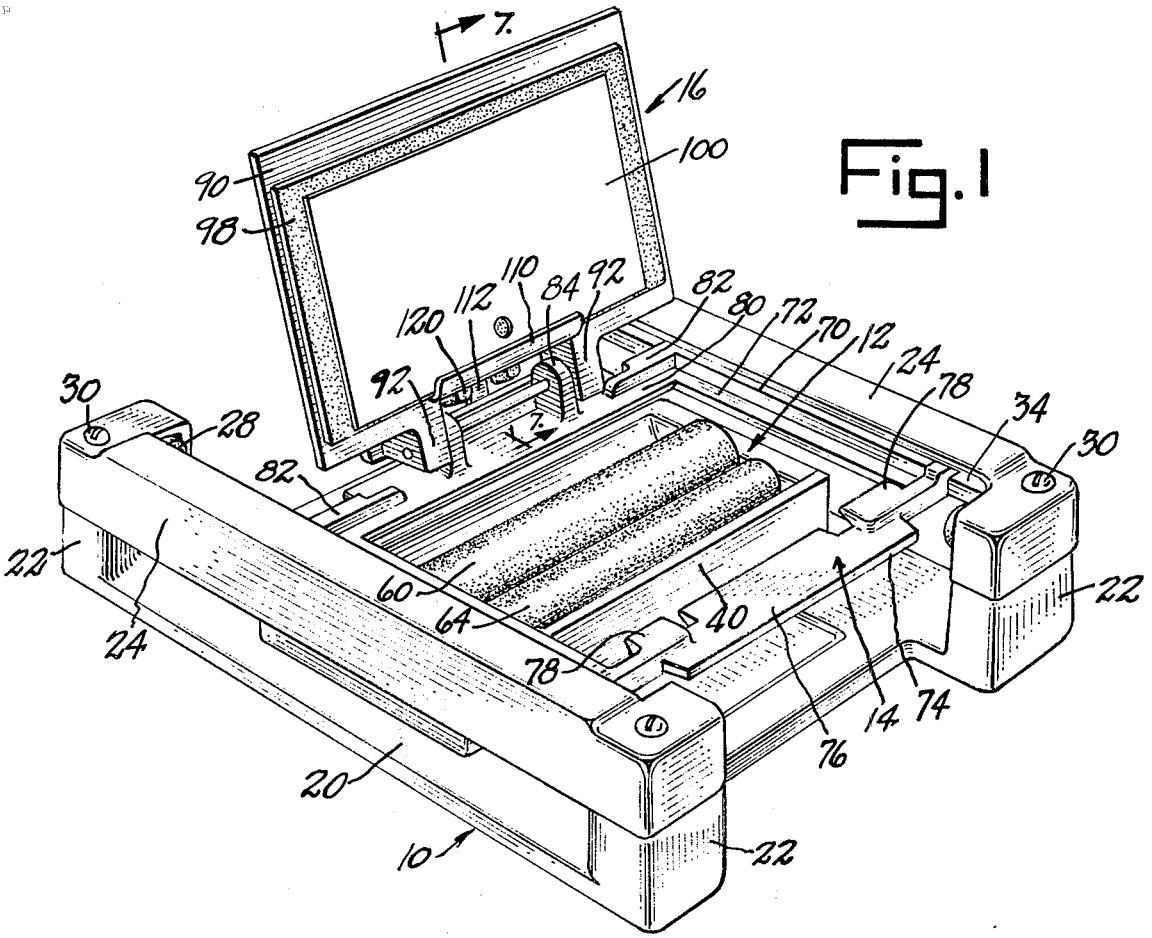
FIG. 1 is a perspective view of the device in cardloading position with a card to be stenciled mounted therein.
Figure 2:
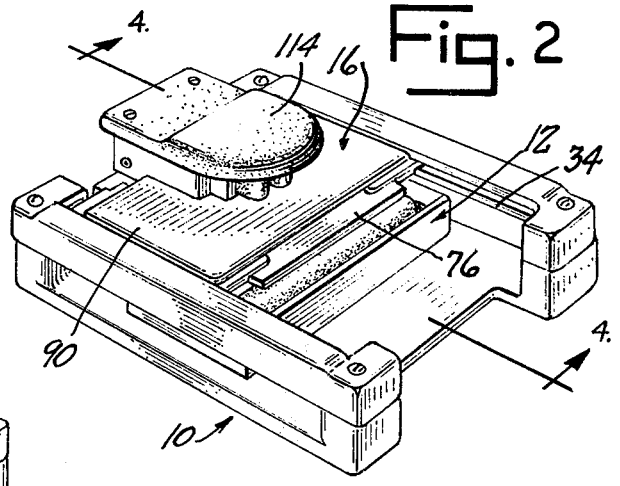
FIG. 2 is a perspective view of the device in closed position at one limit position thereof.
Figure 3:
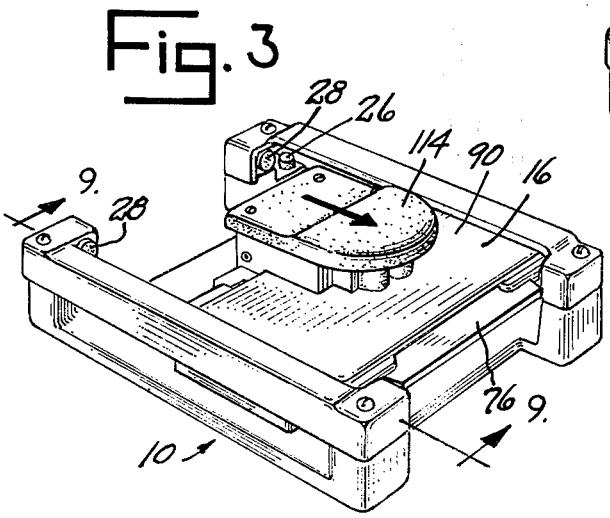
FIG. 3 is a perspective view of the device at its opposite limit position.

Referring to the drawings which illustrate the preferred embodiment of the invention, the numeral 10 designates a frame which carries an inking mechanism 12 and slidably mounts a stencil carrier 14 which in turn mounts a card carrier 16.

Figure 4:
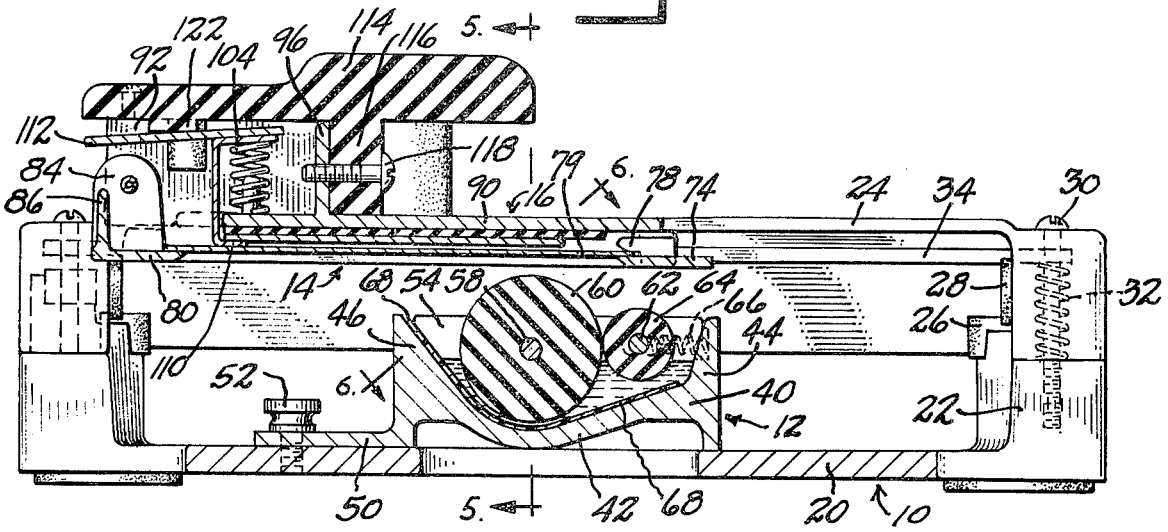
FIG. 4 is a longitudinal vertical sectional view taken on line 4—4 of FIG. 2.
Figure 5:
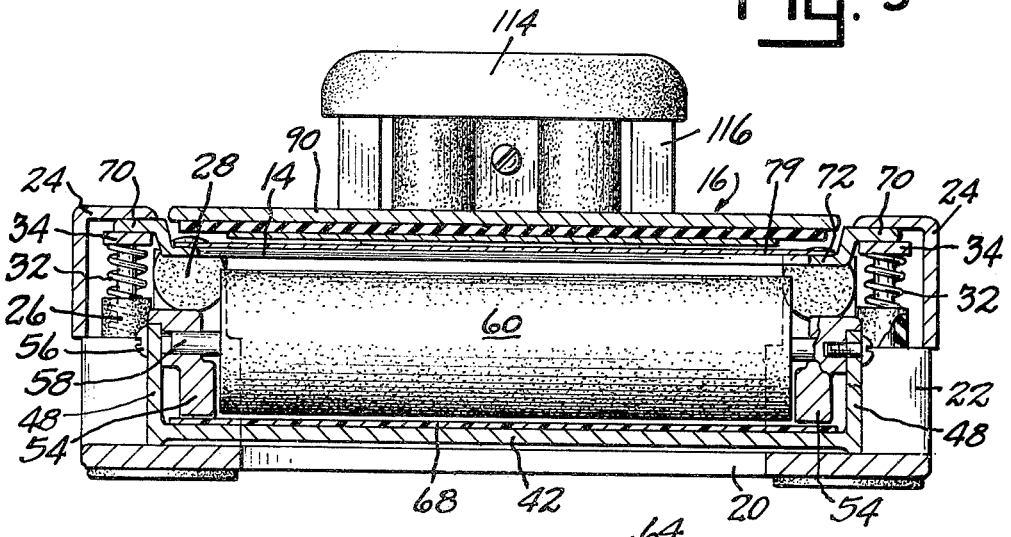
FIG. 5 is a vertical transverse sectional view taken on line 5—5 of FIG. 4.
Figure 9:
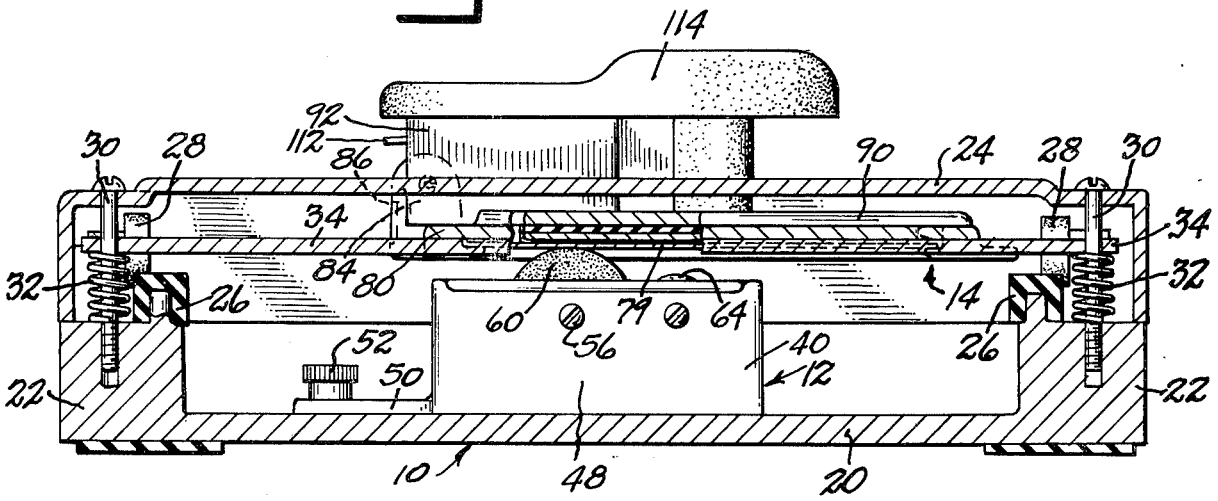
FIG. 9 is a longitudinal vertical sectional view taken on line 9—9 of FIG. 3.

The frame 10 includes a base plate 20 of generally H-shape or over-all rectangular outline and upwardly projecting corner posts 22 at the four corners thereof. The corner posts at each side of the frame support spaced substantially parallel longitudinal frame bars 24. Each corner post preferably carries a pad 26 formed of resilient or cushioning material and projecting upwardly therefrom. Each of the frame bars 24 preferably mounts an inwardly projecting resilient pad 28 adjacent the opposite ends thereof. The parallel frame bars 24 are preferably of angle shape in cross section and include inwardly projecting end portions at which the pads 28 are anchored. Bars 24 are secured in place by means of securing screws 30 screw threaded into the corner posts, as seen in FIG. 9. A coil spring 32 encircles each screw 30 and each serves to normally urge upwardly one end of a guide bar 34 normally extending substantially parallel to the frame member 24 and therebelow. Each bar 34 is normally positioned in an upper position, as seen in FIGS. 4 and 5 but upon compression of the spring 32 yields to a lowered position as illustrated in FIG. 9. Each bar 34 has apertures at its opposite ends fitting loosely around the screws 30 to be guided by the screws upon movement relative to the frame.

Figure 6:
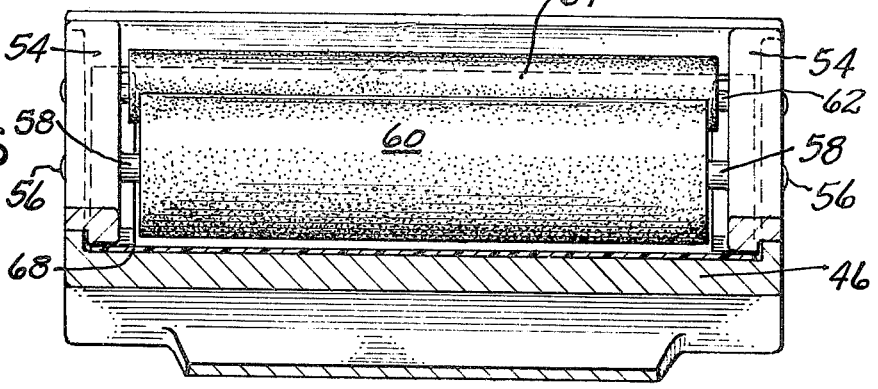
FIG. 6 is a fragmentary transverse sectional view taken on line 6—6 of FIG. 4.

The inking mechanism 12 comprises a shallow ink container 40, best seen in FIGS. 4 and 5. Container 40 is open at its top and has a curved bottom wall 42 merging with end walls 44 and 46. The container also includes side walls 48. A flange 50 projects from the lower portion of the container 40 and bears upon the base 20 and is anchored thereto by a pair of laterally spaced thumb screws 52, which are readily released to permit detachment and reattachment of the ink container. A bearing block 54 is removably anchored in the ink container at each side wall 48 thereof by securing screws 56. Each bearing block has a bearing aperture therein to journal one end of a shaft 58 of a large inking roller 60. The diameter of the inking roller 60 is such that the roller projects into the container at the deepest part thereof and projects substantially above the top of the container. Each bearing block 54 also has a horizontally elongated slot therein slidably receiving a projecting end of a shaft 62 of a second roller 64 of smaller diameter than roller 60 and urged against roller 60 by means of springs 66. The bearing blocks 54 are contoured at their bottoms to conform to the contour of the bottom wall 42 and at least one end wall 46 and are spaced from the bottom 42 and end wall 46 uniformly a slight distance to define guide slots and releasably retain slidably receive, the margins of a flexible sheet 68, preferably formed of plastic sheet material. Sheet 68 spans the lower portion of the ink container with one end thereof terminating near the top of the ink container in the normal position of the parts as illustrated in FIG. 4. As best seen in FIGS. 5 and 6, sheet 68 extends substantially the full width of the ink container between the side walls 48 thereof.

The stencil carrier 14, best illustrated in FIGS. 1, 4, 5 and 9, constitutes a rectangular marginal frame having horizontal side bars 70 bearing and slidable upon the guide bars 34. The inner margins of the side bars are horizontal and downwardly offset at 72. An end bar 74 connects side bars 70 at one end and at its central portion 76 has its top surface substantially flush with downward offset side bar parts 72. At opposite ends of end bar 74 are provided inwardly projecting parts 78 whose lower surfaces are positioned in a plane slightly above the plane of the top surface of the central portion 76 so that one end of a stencil sheet 79 may rest upon the top surface of the central portion of the end bar 74 and will underlie the inner portions of the projections 78. The opposite end of the stencil frame includes a transverse part 80 having a top surface substantially flush with the downwardly offset side bar parts 72. Upwardly projecting parts 82 on end bar 80 provide stops for positioning one end of a stencil 79 which bears against bar 80 and the offset side bar parts 72. A pair of laterally spaced upwardly projecting lugs 84 carried by end bar 80 are located outwardly relative to the inner surfaces of the upwardly projecting stops 82 between which they are positioned. An upwardly projecting flange or abutment 86 is formed on end bar 80 between the lugs 84, as best seen in FIGS. 7 and 8.

Figure 7:
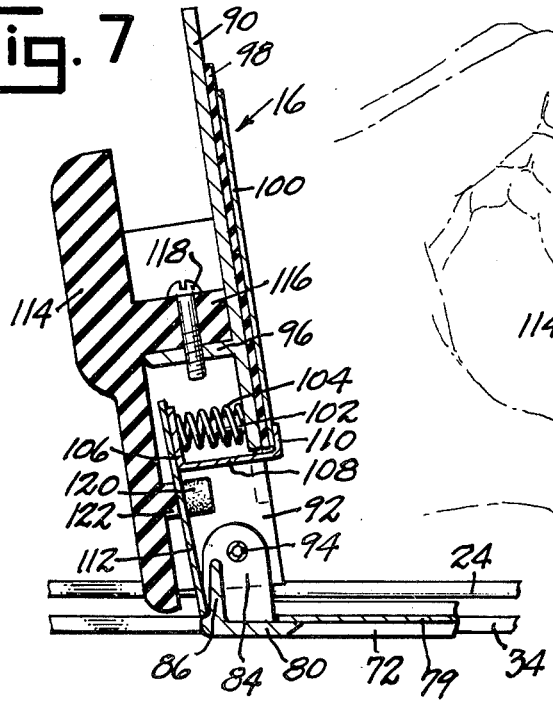
FIG. 7 is a fragmentary transverse sectional view taken on line 7—7 of FIG. 1 and illustrating the card holder of the device.
Figure 8:
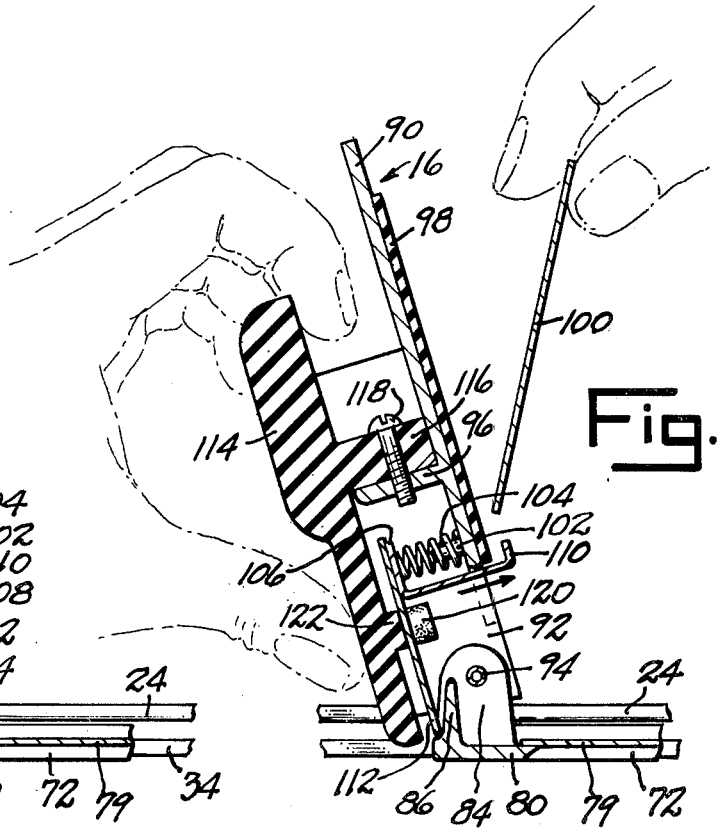
FIG. 8 is a fragmentary transverse sectional view taken on line 7—7 of FIG. 1 and illustrating the manipulation of the card holding device.

The card carrier 16 is best illustrated in FIGS. 1, 4, 5, 7, 8 and 9. The card carrier includes a substantially flat plate 90 from one end of which project a pair of spaced lugs 92 positioned adjacent the outer surfaces of the lugs 84 and pivoted thereto by a pivot pin 94. The lugs 92 project upwardly from the plate 90 and form part of a U-shaped structure projecting above the plate 90 at one end thereof and including a transverse upwardly projecting wall 96. The bottom surface of plate 90 is preferably covered by a rubber pad or friction sheet 98 against which a stencil card 100 may bear. Mechanism for anchoring the stencil card 100 against the pad 98 is housed within a cavity at the upper side of the plate 90 defined by lugs 92 and transverse wall 96, as best seen in FIGS. 4, 7 and 8. This construction includes a pair of spaced studs 102 projecting upwardly from the plate 90 adjacent the pivoted end of the plate. Each stud is encircled by a coil spring 104 each connected to one end portion of a plate 106 of a cord retainer having a flange 108 bent perpendicularly therefrom and extending beyond the end of the plate 90 and between the lugs 92. An angularly bent gripping flange 110 projects from flange 108 in the direction of the pad 98 and is adapted to be urged into contact with pad 98 by the springs 104. A tripping lever 112 is fixedly secured to retainer plate 106 and projects endwise of the card carrier to terminate adjacent to the flange 86.

A hand grip member, which preferably is formed of rubber or other molded material, includes a top plate portion 114 which bears upon parts 92 and 96 and spans the cavity which receives the coil springs 104 and the retainer plate. The grip member preferably has a depending wall 116 which is secured to the wall 96 of plate 90 by a securing screw 118. The handle preferably includes a pair of spaced depending molded rubber lugs 120 which are located at opposite sides of the tripping lever 112, and a portion 122 of the grip member bears upon an intermediate portion of trip lever 112.

In the use of the device a quantity of ink is introduced into the shallow ink container 40 after the flexible sheet 68 has been positioned in place therein to span the bottom of the container. A stencil 79 is inserted in the stencil holder with its margins resting upon the parts 72, 76 and 80 thereof, preferably abutting the projections 82 at one end of the stencil holder and underlying the projections 78 at the opposite end of the stencil holder. The stencil 79 is readily mounted in this position with minimum manipulation, and when the stencil is of a proper size to fit the stencil holder the stencil will be firmly supported and restrained against undesired free play during use of the device. Insertion of the stencil 79 is readily accomplished while the card carrier is in the open position illustrated in FIGS. 1, 7 and 8.

A card 100 is easily mounted in the card holder in the manner illustrated in FIGS. 7 and 8. It will be noted that as the card holder plate 90 is swung to upright position as accommodated by gripping the handle 114, as illustrated in FIG. 8, the end of trip lever 112 contacts the flange 86 of the stencil carrier. Swinging of the card carrier to full open position, as seen in FIG. 8, while the trip lever 112 abuts the flange 86 results in application of pressure by the hand grip to the trip lever 112 at 122, thereby compressing the coil springs 104 and bodily moving the retainer 106, 108, 110 from the position illustrated in FIG. 7 to the position illustrated in FIG. 8, at which the card gripping flange 110 is spaced from the pad 98 of the carrier plate 90. A card 100 in the carrier is thus released and another card is readily applied between the pad 98 and the gripping flange 110 while the parts are in the FIG. 8 position. Return of the handle 114 and the carrier plate 90 toward normal horizontal position permits the springs 104 to restore the card retainer 106, 108, 110 to the position illustrated in FIG. 7 in which a margin of the card 100 is firmly gripped between the gripping flange 110 and the pad 98.

The stenciling operation is performed after the handle 114 and the card carrier 90 have been lowered to operative horizontal position as illustrated in FIGS. 4 and 9. The actual stenciling action occurs when the parts are in the FIG. 9 position in which pressure has been applied to the handle 114 to lower the level of the card carrier 16 and the stencil carrier 14 to bring the stencil 79 into contact with the inking roller 60. Reciprocal movement of the stencil carrier and card carrier occurs as they travel along the guide bars 34. As this movement occurs, rotation of the inking roller 60 results to transfer ink from the roller 60 to the stencil 79 and through the stencil onto the card 100. The stenciling action preferably occurs as the unit is moved from the right to the left as viewed in FIG. 9, so that the amount of ink contained on the surface of the roller 60 may be regulated by the metering roller 62.

It will be seen that at the end of each stenciling operation the handle 14 can be rapidly swung to the FIG. 8 position to release the stenciled card 100 and to permit a new card to be mounted on the card carrier.

The cleaning of the device is readily accomplished by removal of the ink container upon release of the thumb screws 52. This permits the container to be handled to drain ink therefrom. The rollers 60 and 64 can be readily removed for cleaning by release of the bearing blocks 54. Upon removal of the rollers they can be cleaned easily. The flexible sheet 68 can then be withdrawn and the interior of the ink container is readily accessible for cleaning thereof. Any tendency for ink to cake upon the sheet 68 is readily overcome by virtue of the removability of that sheet and its flexibility.

The shape and nature of the handle and the association of the card clamping means with the handle accommodate comfortable handling and manipulation of the device. The noise of operation of the device is muted by the provision of the rubber bumpers 26 and 28, to cushion impact of metal ports during operation the formation of the handle 114 of rubber, and the rubber handle parts which contact the trip lever 112 and the retainer mechanism.

While the preferred embodiment of the invention has been described herein, it will be understood that changes in the construction may be made within the scope of the appended claims without departing from the spirit of the invention.

What I claim is:

1. In a stencil printer, in combination, a frame a shallow ink container carried by said frame, and open at its top said container having side and end walls and a bottom whose top surface is of curved cross section, bearing members releasably mounted on said side walls within said container and each having a bore, and an inking roll having a shaft with projecting ends journaled in each bearing member bores to position said roller substantially concentrically with a portion of said curved bottom, said bearing members conforming at their lower parts to the contour of said bottom and end wall surfaces and spaced slightly therefrom to define guide slots at opposite sides of said container, and a flexible plastic sheet spanning the lower portion of said container and slidably retained in said guide slots.

2. In a stencil printer, in combination, a frame, a stencil carrier shiftable and slidable on said frame, a card carrier pivoted on said stencil carrier said card carrier including a plate, a card retainer, a spring resiliently urging said retainer to retaining relation to said plate and a tripping lever, and an abutment on said stencil carrier engageable by said tripping lever as said card carrier pivots toward open position to shift said lever and flex said retainer spring and shift said card retainer relative to said plate to a position to release a card.

3. A stencil printer as defined in claim 2, and a handle mounted on said card carrier and cooperating therewith to substantially enclose said tripping lever and retainer spring.

4. A stencil printer as defined in claim 2, wherein said card retainer is bent around a margin of said plate adjacent the pivot of said card carrier.

5. A stencil printer as defined in claim 2 wherein said plate mounts a stud, said retaining spring encircles said stud and said card retainer is bent around a margin of said plate and carries said tripping lever.

* * * * *

UNITED STATES PATENT OFFICE

CERTIFICATE OF CORRECTION

Patent No. 3,956,984 Dated May 18, 1976

Inventor(s) John Chien Kuen Kiang

It is certified that error appears in the above-identified patent and that said Letters Patent are hereby corrected as shown below:

On the cover sheet insert:

-- [73] Assignee: Gaylord Bros., Inc.,

Liverpool, New York --.

Signed and Sealed this

Twenty-eighth Day of June 1977

[SEAL]

*Attest:*

RUTH C. MASON
*Attesting Officer*

C. MARSHALL DANN
*Commissioner of Patents and Trademarks*